US005743356A

United States Patent [19]

Mitchell

[11] Patent Number: 5,743,356

[45] Date of Patent: Apr. 28, 1998

[54] GUTTER BUDDY LADDER EXTENDER

[76] Inventor: Frank A. Mitchell, 883 N. Ellsworth Ave., Columbiana County, Salem, Ohio 44460

[21] Appl. No.: 677,879

[22] Filed: Jul. 10, 1996

[51] Int. Cl.[6] ..... E06C 7/48

[52] U.S. Cl. ..... 182/214; 182/107; 182/229

[58] Field of Search ..... 182/107, 214, 182/229

[56] References Cited

U.S. PATENT DOCUMENTS

| | | | |
|---|---|---|---|
| 3,318,416 | 5/1967 | Robinson | 182/214 |
| 4,194,592 | 3/1980 | Evans | 182/214 |
| 4,339,020 | 7/1982 | Wiseman | 182/214 |
| 4,444,291 | 4/1984 | McPherson | 182/214 |
| 4,580,660 | 4/1986 | Oling | 182/214 X |
| 5,165,501 | 11/1992 | Donahey | 182/214 |
| 5,180,032 | 1/1993 | Hidalgo | 182/214 |

FOREIGN PATENT DOCUMENTS

| | | | |
|---|---|---|---|
| 2118236 | 10/1983 | United Kingdom | 182/107 |

*Primary Examiner*—Alvin C. Chin-Shue
*Assistant Examiner*—Long Dinh Phan
*Attorney, Agent, or Firm*—Frederic E. Naragon

[57] ABSTRACT

A ladder extender apparatus for use with a ladder with stiles and rungs to extend the ladder away from a structure, during use and adapted to accept any width ladder, hollow runged or solid runged, comprising a flat base plate to engage with the roof of the structure, two support arms rigidly affixed to the base plate by two L-shaped channels and extending vertically away from the base plate adjustable horizontally with the base plate, a corresponding pair of extension arms pivotally secured at one end with a rod to the pair of support arms allowing the base plate to pivot about the axis of the rod and adjust to the pitch of the roof of the structure and adjustable by a plurality of orifices in the support arms to vary the distance of the ladder from the structure and with the other ends of the extension arms secured to a ladder fastener assembly to fasten the apparatus to the stiles and rungs of the ladder, where the ladder fastening assembly can be either a pair of generally U-shaped channels with slots adapted to accept and engage two rungs of the ladder with a security fastening means to prevent the channels from disengaging from the ladder or a pair of blocks with orifices to provide for the sliding of a rod through the blocks and a hollow rung of a ladder with slots in the blocks adapted to slidably engage with the stiles of the ladder.

3 Claims, 5 Drawing Sheets

GUTTER BUDDY LADDER EXTENDER

BACKGROUND OF THE INVENTION AND SUMMARY OF THE INVENTION

The present invention relates generally to a ladder extender apparatus for attachment to a ladder having a pair of stiles and rungs and more particularly pertains to a new and improved ladder extender apparatus which is arranged to position and secure a ladder in a non-sliding relationship relative to and extended away from a dwelling or structure during use.

Ladder apparatus of various types have been utilized in the prior art to secure and position a ladder relative to and extended away from a dwelling during use, however, such structures of the prior art have typically been of a complex and cumbersome organization and structure discouraging their use.

The prior art discloses patents for ladder extender apparatus and some of the patents are listed as follows:

U.S. Pat. No. 3,318,416—Billie Robinson May 9, 1967

U.S. Pat. No. 4,194,592—Lewis L. Evans Mar. 25, 1980

U.S. Pat. No. 4,339,020—Donald H. Wiseman Jul. 13, 1982

U.S. Pat. No. 4,444,291—Larry T. McPherson Apr. 24, 1984

U.S. Pat. No. 5,165,501—Howard E. Donahey Nov. 24, 1992

U.S. Pat. No. 5,180,032—Martiniano A. Hidalgo Jan. 19, 1993

U.S. Pat. No. 3,318,416 issued to Billie Robinson on May 9, 1967, pertains to an apparatus to extend the stiles of a ladder away from a dwelling during use, however, this invention comprises complex and unstable recesses to engage the ladder and pivotal means to secure a pad against the roof of the dwelling. The apparatus is further not adjustable to extend the ladder various distances from the dwelling as is provided in the present invention.

U.S. Pat. No. 4,194,592 issued to Lewis L. Evans on Mar. 25, 1980, also pertains to an apparatus to extend the stiles of the ladder away from a dwelling during use and provides for a flat surface to be placed against the roof of the dwelling during use, however, the apparatus teaches of a complex and cumbersome means of fastening the apparatus to the ladder comprising arms and braces and further provides no adjustability as to the arms to extend the ladder various distances from the dwelling as is provided in the present invention.

U.S. Pat. No. 4,339,020 issued to Donald H. Wiseman on Jul. 13, 1982, illustrates an apparatus to extend a ladder away from the vertical sides of a dwelling but teaches of a complex means of U brackets and screw apparatus to secure the invention to the ladder and to adjust to the size of the ladder. The invention further teaches of a complex slot and screw means to extend the ladder various distances from the dwelling. The present invention provides an improved apparatus which engages with the roof of any pitch of the structure and prevents damage to the vertical sides of the structure and further provides for simplified and less complex adjustability of the ladder away from the structure.

U.S. Pat. No. 4,444,291 issued to Larry T. McPherson on Apr. 24, 1984, further illustrates an apparatus to extend the stiles of a ladder away from the wall of a dwelling by use of a flat pad, brackets and a complex box apparatus to secure the invention to the ladder. There is no adjustability for extending the ladder various distances from the dwelling as is provided in the present invention.

U.S. Pat. No. 5,165,501 issued to Howard E. Donahey on Nov. 24, 1992, teaches of an apparatus to extend the stiles of a ladder away from the roof of a dwelling during use which is adjustable in varying the distance of the ladder from the roof by a complex and cumbersome pin and slot apparatus. The invention further provides for a cumbersome, multiple, bracketed support means to attach to the ladder and is only useable for ladders with hollow rungs. The present invention provides for simplified and less complex attachment to the ladder and adjustability for varying the distance of the ladder away from the structure.

U.S. Pat. No. 5,180,032 issued to Martiniano A. Hidalgo on Jan. 19, 1993, teaches of a complex and relatively unstable pivotable block means to engage the roof of a dwelling, a complex slotted channel apparatus to adjust the distance of the ladder stiles varying distances from the dwelling, and a complex securing and brace means to secure the apparatus to the ladder. The present invention provides for simplified and less complex attachment to the ladder and adjustability for varying the distance of the ladder away from the structure.

In view of the foregoing disadvantages inherent in the known types of ladder apparatus now present in the prior art, the present invention provides a ladder extender apparatus wherein the same is arranged to provide for the adjusting projection of the ladder away from the structure or dwelling during the use of the ladder. The general purpose of the present invention which will be described hereafter in greater detail is to provide a new and improved ladder extension apparatus which has all the advantages of the prior art ladder apparatus and none of the disadvantages.

The present invention provides an apparatus which will extend the stiles of the ladder away from the structure or dwelling during its use and is useable and unique when cleaning debris from guttering and reduces wear on the guttering. The present invention comprises a flat base plate to engage with the roof of a dwelling or structure, two support arms rigidly affixed to the base plate by two L-shaped channels and extending vertically away from the base plate and adjustable horizontally with the base plate to accommodate the width of any ladder in use, a corresponding pair of extension arms pivotably secured at one end with a rod to the pair of support arms to allow the base plate to pivot about the axis of the rod and adjust to the pitch of the roof on any desired dwelling or structure during use and further adjustable by a plurality of orifices in the support arms to vary the distance of the ladder from the dwelling or structure during use, and with the other ends of the extension arms secured to a ladder fastener assembly to fasten the apparatus to the stiles and rungs of the ladder in use. The ladder fastener assembly can be either in preferred form a pair of generally U-shaped channels with slots adapted to accept and engage two rungs of the ladder in use with a security fastening means to prevent the channels from disengaging from the ladder during use, or a pair of blocks with orifices to provide for the sliding of a rod through the blocks and a hollow rung of a hollow runged ladder and with slots in the blocks adapted to slidably engage with the stiles of the ladder in use.

The invention resides not in any one of these features per say but rather in the particular combination of all of them herein disclosed and claimed and it is distinguished from the prior art in this particular combination of all of its structures for the functions specified. The summary herein is neither intended to define the invention of the application which is set forth in the claims nor is it intended to be limiting as to the scope of the invention in any way but merely for the purpose of generally describing the invention and to provide a cursory disclosure of the application.

Therefore, the present invention provides a new and improved ladder extender apparatus which has all the advantages of the prior art ladder apparatus and none of the disadvantages. Further, the present invention may be easily and efficiently manufactured and marketed at low cost and readily affordable to the buying public. A more detailed understanding of the present invention and its uses may be attained by examination of the accompanying drawings and descriptive matter in which the embodiment of the invention is illustrated.

ABSTRACT OF THE DRAWINGS

Figure 1:
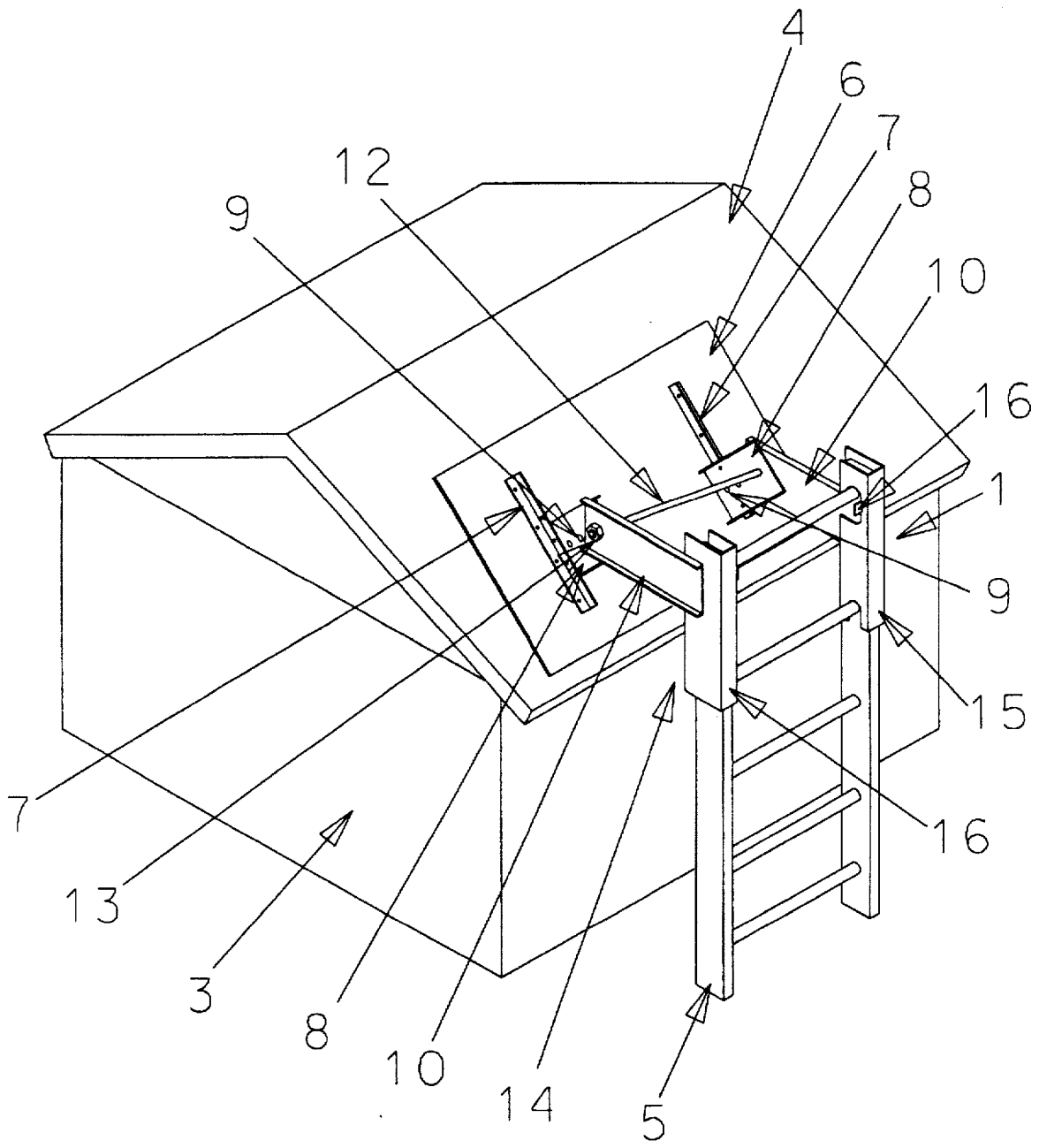
FIG. 1 is a perspective view of the preferred embodiment of the present invention in position with a roof of a structure.

1 is the preferred embodiment of the present invention;
2 is the secondary embodiment of the present invention;
3 is a structure;
4 is a structure roof;
5 is a ladder with stiles and rungs;
6 is a flat base plate;
7 is an L-shaped channel;
8 is a support arm;
9 is a support arm orifice;
10 is an extension arm;
11 is an extension arm orifice;
12 is a rod;
13 is a rod securing means;
14 is a preferred ladder fastener assembly;
15 is a U-shaped channel;
16 is a channel notch;
17 is a security fastening means;
18 is a hollow rung ladder fastener assembly;
19 is a block;
20 is a block rod orifice;
21 is a block rod;
22 is a block rod fastening means;
23 is a block fastening means;
24 is a block stile slot.

DETAILED DESCRIPTION OF THE DRAWINGS

Reference is now made to the drawings wherein the present invention is illustrated in detail and wherein similar components bear the same reference numeral throughout the several views.

FIG. 1 is a perspective view of the preferred embodiment of the present invention 1 in position with a roof 4 of a structure 3 and ladder with stiles and rungs 5, and illustrates the base plate 6, L-shaped channels 7, support arms 8, support arm orifices 9, extension arms 10, rod 12, rod securing means 13, preferred ladder fastener assembly 14, U-shaped channels 15, channel notches 16, and security fastening means 17.

Figure 2:
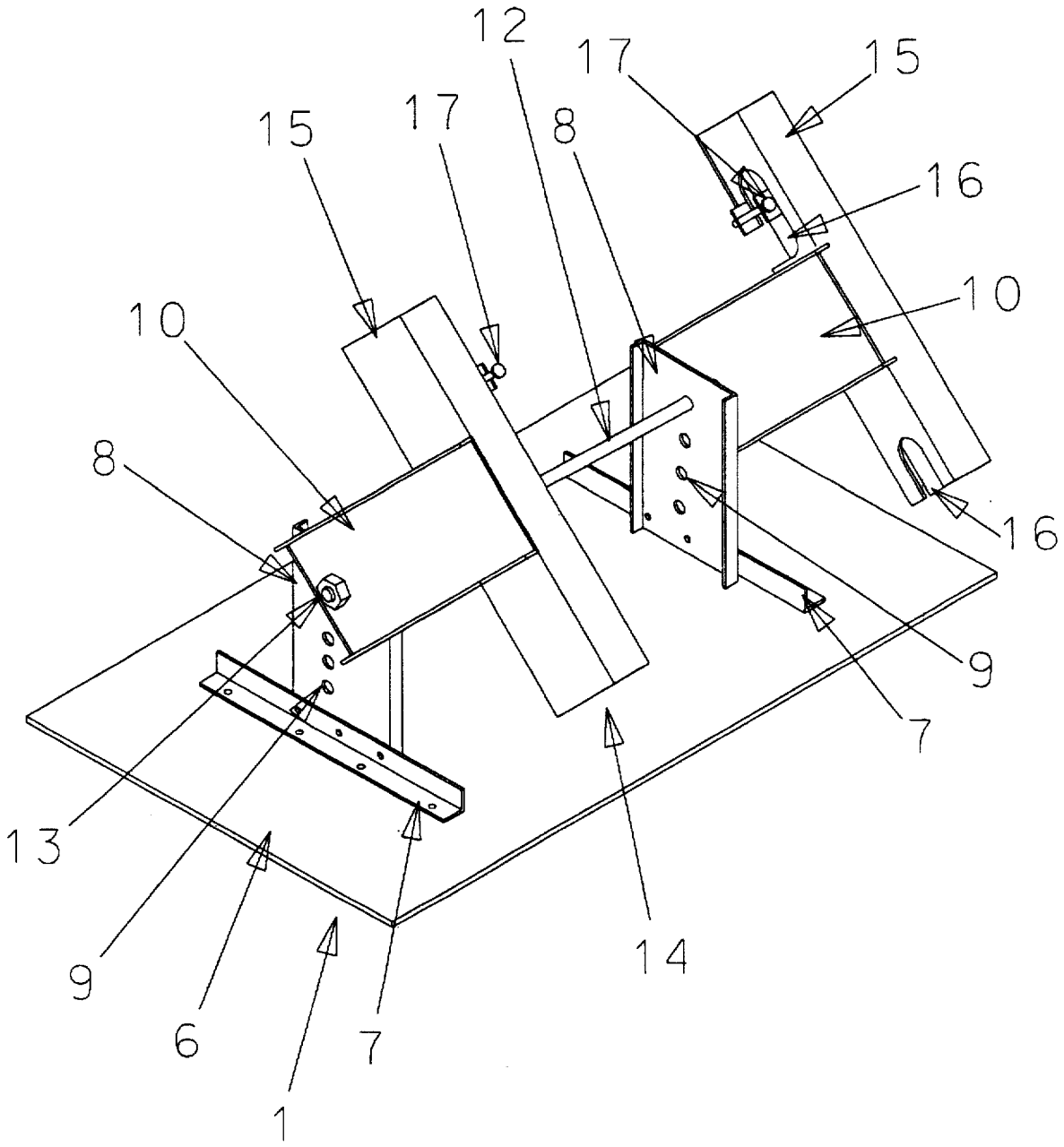
FIG. 2 is a perspective view of the preferred embodiment of the present invention.

FIG. 2 is a perspective view of the preferred embodiment of the present invention 1 and illustrates base plate 6, L-shaped channels 7, support arms 8, support arm orifices 9, extension arms 10, rod 12, rod securing means 13, preferred ladder fastener 14, U-shaped channels 15, channel notches 16, and fastening means 17.

Figure 3:
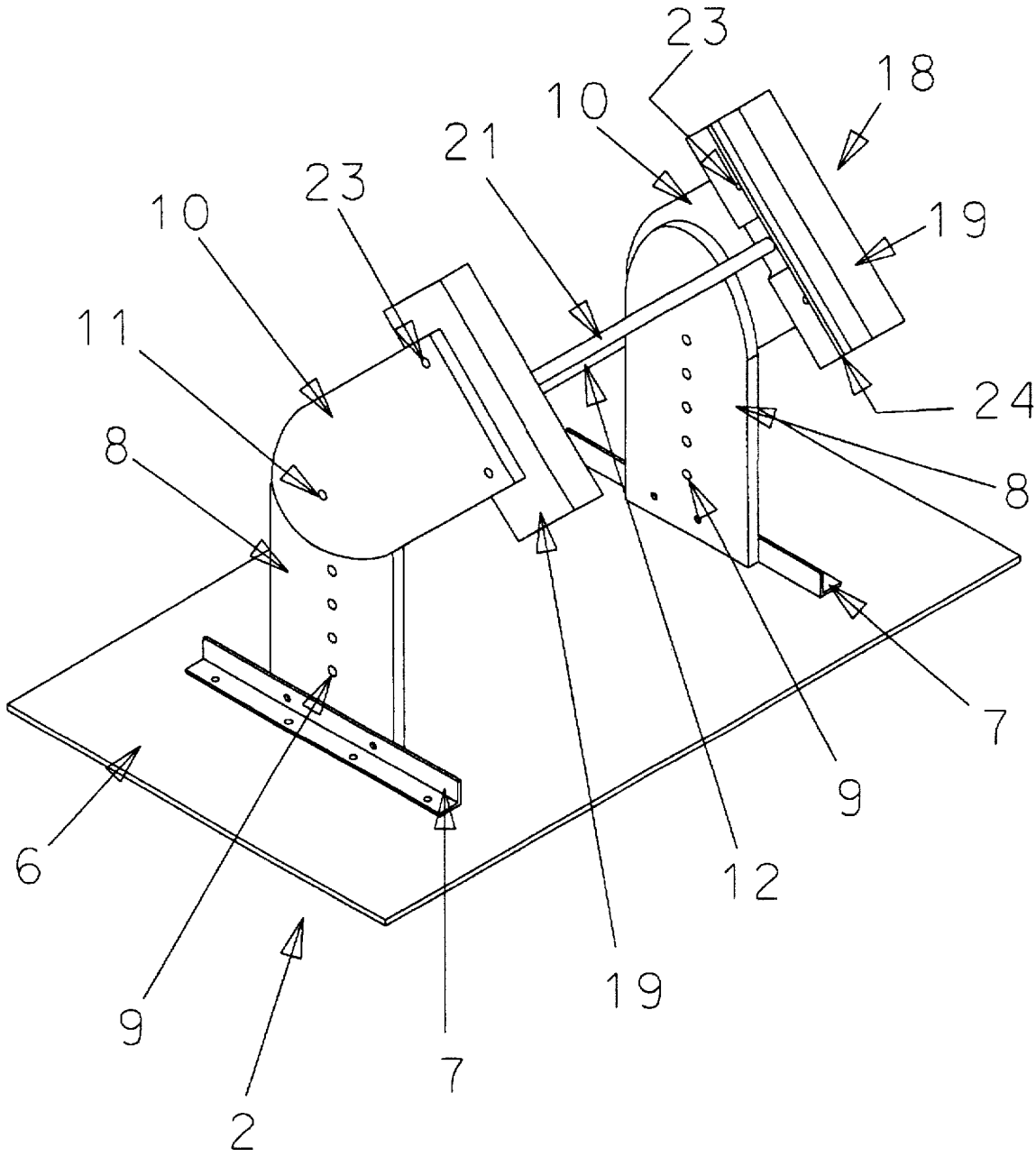
FIG. 3 is a perspective view of a secondary embodiment of the present invention.

FIG. 3 is a perspective view of a secondary embodiment of the present invention 2 and illustrates base plate 6, L-shaped channels 7, support arms 8, support arm orifices 9, extension arms 10, hollow rung ladder fastener assembly 18, blocks 19, block rod 21, block fastening means 23, and block stile slot 24.

Figure 4:
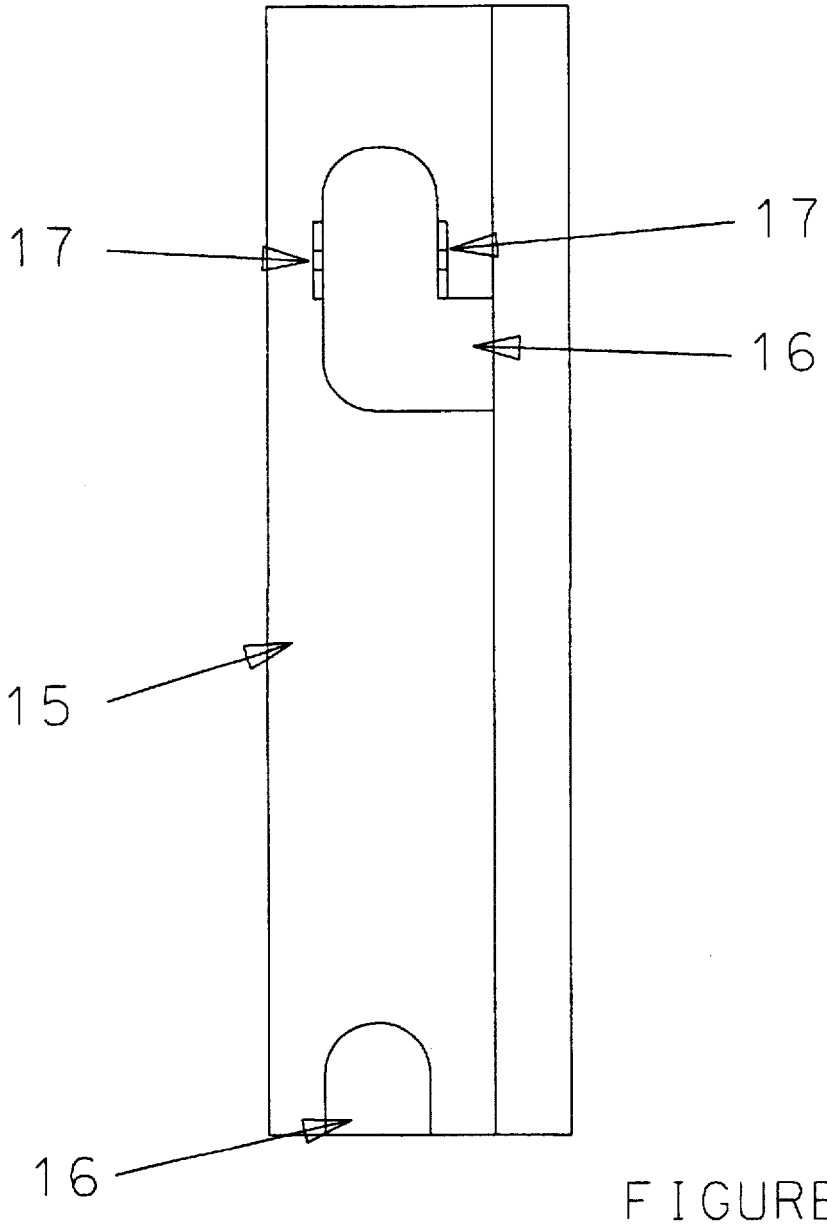
FIG. 4 is a side view of the U-shaped channel of the preferred ladder fastener assembly.

FIG. 4 is a side view of the U-shaped channel 15 of the preferred ladder fastener assembly 14 and illustrates U-shaped channel 15, channel notches 16, and security fastening means 17.

Figure 5:
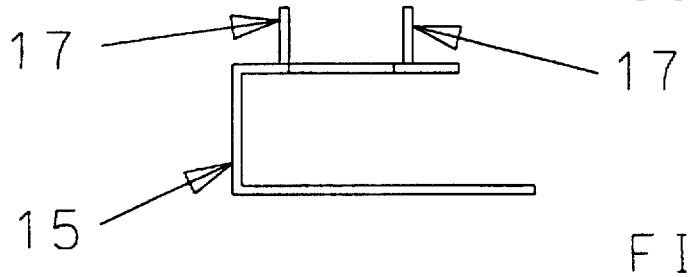
FIG. 5 is an end view of the U-shaped channel of the preferred ladder fastener assembly.

FIG. 5 is an end view of the U-shaped channel 15 of the preferred ladder fastener assembly 14 and illustrates U-shaped channel 15 and security fastening means 17.

Figure 6:
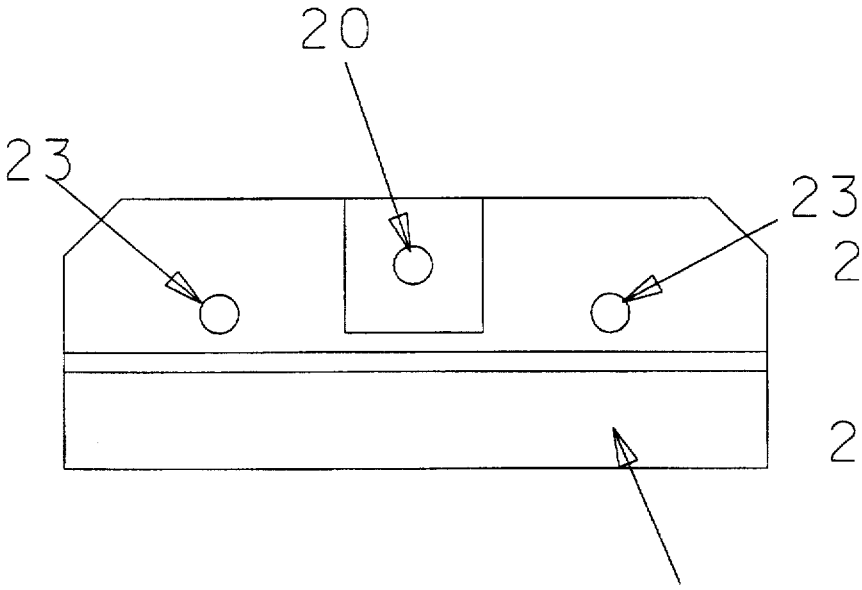
FIG. 6 is a side view of the block of the hollow rung ladder fastener assembly.

FIG. 6 is a side view of the block 19 of the hollow rung ladder fastener assembly 18 and illustrates block 19, block rod orifice 20, block fastening means 23, and block stile slot 24.

Figure 7:
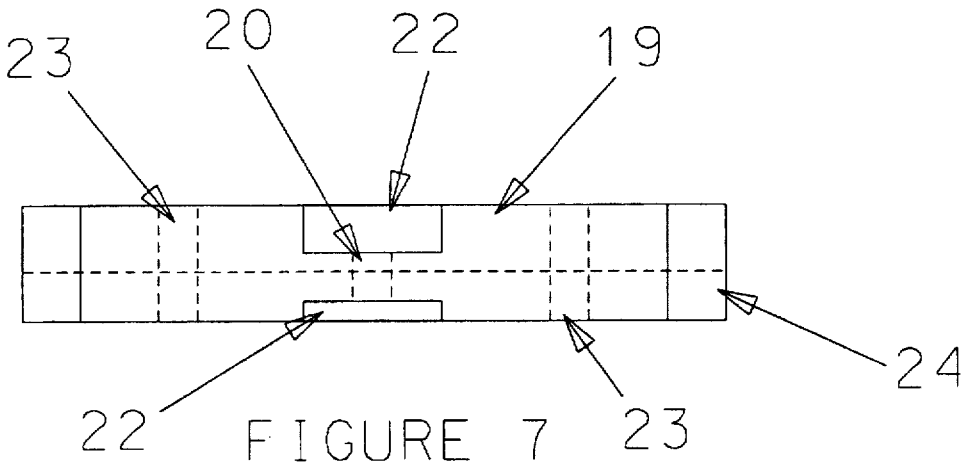
FIG. 7 is a top view of the block of the follow ladder fastener assembly.

FIG. 7 is a top view of the block 19 of the hollow ladder fastener assembly 18 and illustrates block 19, block rod orifice 20, block rod fastening means 22, block fastening means 23, and block stile slot 24.

Figure 8:
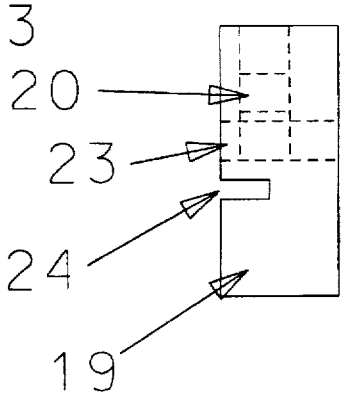
FIG. 8 is an end view of the block of the hollow ladder fastener assembly.

FIG. 8 is an end view of the block 19 of the hollow rod fastener assembly 18 and illustrates block 19, block rod orifice 20, block fastening means 23, and block stile slot 24.

DESCRIPTION OF THE PREFERRED EMBODIMENT

Referring to FIGS. 1 through 8 the preferred embodiment of the present invention comprises a base plate to engage with the roof of a dwelling or structure, two support arms rigidly affixed to the base plate by two L-shaped channels and extending vertically and downwardly away from the base plate and adjustable horizontally with the base plate to accommodate the width of any ladder in use, a corresponding pair of extension arms pivotally secured at one end with a rod to the pair of support arms to allow the base plate to pivot about the axis of the rod and to adjust to the pitch of the roof of any desired dwelling or structure during use and further adjustable by a plurality of orifices in the support arms to vary the distance of the ladder from the dwelling or structure during use and with the other ends of the extension arms secured to a preferred ladder fastener assembly to fasten the apparatus to the stiles and rungs of the ladder in use comprising a pair of generally U-shaped channels with slots adapted to accept and engage two rungs of the ladder in use with a security fastening means to prevent the channels from disengaging from the ladder during use. The preferred embodiment of the present invention can be employed with any ladder whether solid runged or hollow runged.

Although the invention has been described in preferred form with a certain degree of particularity, it is understood that the present disclosure of the preferred form has been made only by way of example and numerous changes in the details of construction and the combination arrangement of parts may be resorted to without departing from the spirit and scope of the invention as hereinafter claimed.

What is claimed is:

1. A ladder extender apparatus to extend a ladder away from a structure during use for a ladder having a pair of stiles connected together by a plurality of rungs which comprises a flat base plate having a length adapted to be greater than the width of the ladder with a plane of said plate adapted to be in contact with the roof of a structure ranging from a flat roof to a roof of any vertical pitch, a pair of support arms at one end removably and adjustably attached to said flat base plate by a corresponding pair of L-shaped channels and to be secured to said flat plate at widths corresponding with the ladder in use, said support arms extending generally vertically and downwardly from said flat base plate and adapted at the opposite end to pivotably attach to a pair of extension arms, said pair of L-shaped channels each fastened one side to one support arm and fastened on the other side to the flat base plate and spaced on the flat base plate to accommodate the width of the ladder, said pair of extension arms at one end pivotably attached to each of said support arms by a rod and rod fastening means adapted to pivot about the axis of the rod and adjust to the pitch of the roof of the structure and at the other end adapted to attach to a ladder fastener assembly to secure the apparatus to the ladder, said rod extending perpendicular to and through an orifice in one end of each support arm and each extension arm to allow the support arms and extension arms to pivot about the axis of the rod, said rod fastening means to fasten the rod to the support arms and extension arms, a plurality of orifices disposed along the vertical axis of support arms adapted to accept the rod and the pair of extension arms to adjustably vary the distance of the ladder form the structure, said ladder fastener assembly attached by means at one end of each of the extension arms and adapted to secure and engage the apparatus to the stiles and rungs of the ladder, and fastening means to secure the ladder fastener assembly to the extension arms.

2. The ladder extender apparatus of claim No. 1 wherein the ladder fastener assembly comprises a pair of generally U-shaped channels secured on one side by means to one end of each extension arm with slots in each channel adapted to accept and engage two rungs of the ladder and a security fastening means adapted on each channel to prevent the channels from disengaging from the ladder during use.

3. The ladder extender apparatus of claim No. 1 wherein the ladder fastener assembly comprises a pair of blocks each slotted to slidably engage with one stile of the ladder and each block secured by means to one end of each extension arm and an orifice disposed through each block to engage a rod, a rod secured and adapted by means to slide through the orifice of each block and through the rung of a hollow runged ladder, and rod fastening means to secure the rod at its ends to each block and to prevent the rod from sliding through the blocks or ladder rung during use.

* * * * *